United States Patent [19]

Henneuse

[11] Patent Number: 4,538,491

[45] Date of Patent: Sep. 3, 1985

[54] CENTERING DEVICE FOR A FOOD SLICER

[75] Inventor: Donald P. Henneuse, Scotts Valley, Calif.

[73] Assignee: Magnuson Corporation, Reno, Nev.

[21] Appl. No.: 481,399

[22] Filed: Apr. 1, 1983

[51] Int. Cl.[3] ..... B26D 1/143; B26D 7/06

[52] U.S. Cl. ..... 83/402; 83/425; 83/444; 83/446; 83/491

[58] Field of Search ..... 83/444, 446, 449, 402, 83/425, 491

[56] References Cited

U.S. PATENT DOCUMENTS

| | | | |
|---|---|---|---|
| 224,631 | 2/1880 | Berzine | 83/446 |
| 343,983 | 6/1886 | Canedy | 83/446 |
| 3,108,625 | 10/1963 | Lamb et al. | 83/402 |
| 3,109,468 | 11/1963 | Lamb et al. | 83/402 X |
| 3,848,498 | 11/1974 | Lazzarini | 83/401 |
| 4,082,024 | 4/1978 | Hodges et al. | 83/402 |
| 4,163,406 | 8/1979 | Crawford | 83/424 |
| 4,228,963 | 10/1980 | Yamauchi et al. | 83/444 X |

*Primary Examiner*—Frank T. Yost
*Attorney, Agent, or Firm*—Gerald L. Moore

[57] ABSTRACT

A centering device for positioning articles (33) for segmenting by passage through a cutter mechanism (18). The device comprises a plurality of spring members (31) positioned edge-to-edge around the feed line (26) with each spring member having a depending end (31A) positioned to contact and deflect each off center article towards the feed line for proper centering such that passage through the cutter mechanism will render equal sized segments.

1 Claim, 6 Drawing Figures

CENTERING DEVICE FOR A FOOD SLICER

FIELD OF THE INVENTION

This invention relates to a device for centering food articles as they are fed into a slicer for segmenting the articles along a longitudinal axis.

BACKGROUND OF THE INVENTION

For slicing such food articles as pickles and carrots along a longitudianl axis, there are provided slicers such as that disclosed in U.S. Pat. No. 3,848,498, Rotary Slicer for Fruits and Vegetables, issued on Nov. 19, 1974 with Louis Lazzarini as inventor. For the slitting of produce it is necessary to center each article to obtain slivers of substantially equal cross section. One apparatus for centering is disclosed in U.S. Pat. No. 4,163,406, l Centering Device for Feeding Articles to a Food Slicer, issued on Aug. 7, 1979 with Lynn Crawford as inventor. In this apparatus counterdriven belts are positioned around the entry path to the cutter to center and propel the articles along a substantially horizontal path through the cutters. This type of device functions very well with larger articles or with irregularly shaped articles such as cauliflower heads and the like.

It is the purpose of the present invention to provide a centering mechanism primarily for use with small produce such as pickles and carrots, which mechanism is simple in design and efficient in operation.

SUMMARY OF THE INVENTION

A centering device for feeding articles such as produce into a cutter mechanism which slits the produce along lines parallel to the direction of travel, said centering device comprising a plurality or elongated, flexible planar spring members placed edge to edge and centered around the inlet path to the cutter. The spring members are supported at the upstream end with the free ends being positioned closest to the cutter. The attached ends are spaced further away from the flight path than the free ends with the free ends being positioned closer together than the diameter of the smallest produce to be cut whereby with the produce being fed along the flight path and between the flexible members, these members flex to allow passage of the article yet tend to center the article on the flight path for proper cutting.

DESCRIPTION OF THE INVENTION

Figure 1:
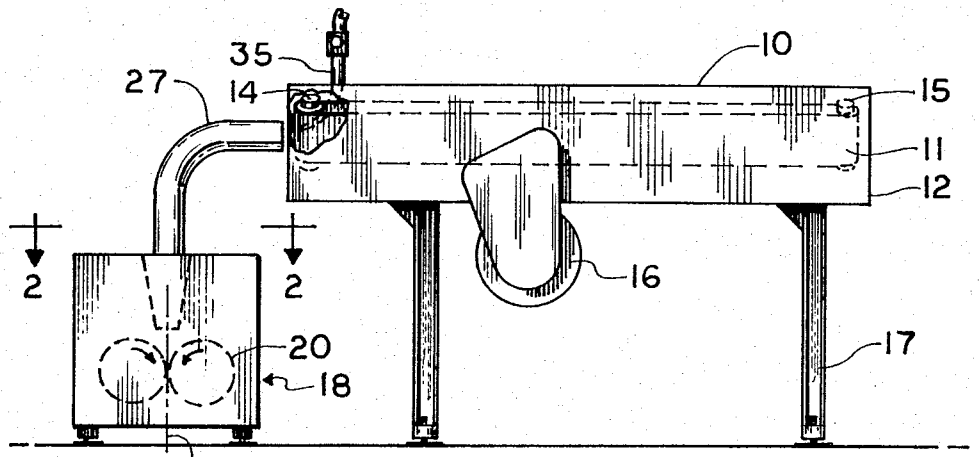
FIG. 1 is a side view of apparatus employing the subject invention.

The apparatus shown in FIG. 1 is for slicing pickles, carrots and the like along a longitudinal axis as they are fed in single file order. The apparatus incorporates a singulator (not shown) which conveys the articles in single file order to the V-belt conveyor 10. This type of conveyor is well known and generally comprises a pair of feed belts 11 supported on a frame 12 for rotation about spaced rollers 14 and 15. At least one of each pair of rollers is power driven by a motor 16. The frame is supported on legs 17. The feed belts are positioned with the inner portions forming a trough or V and are driven in the same direction. The produce is carried therealong to a slicing apparatus 18. Such V-belt conveyors are well known and are not a part of the present invention.

Figure 2:
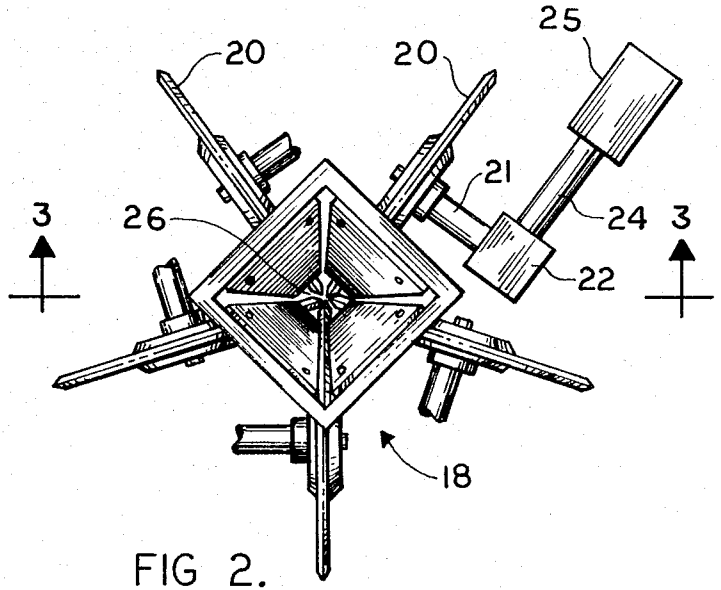
FIG. 2 is a view along line 2—2 of FIG. 1 showing the individual cutters and the centering device.

The cutter mechanism 23 comprises a plurality of discs 20 (FIG. 2) supported on a rotatable shaft 21 which are driven by a gear box 22. Each gear box in turn is driven by a shaft 24 connected with an individual motor 25 (or a gear box if the apparatus is to be driven by a single motor). Each of the rotary or disc blades are sharpened on the outer edge so as to sever produce and the like fed along a center line 26. Such a cutter is better disclosed in the U.S. Pat. No. 4,163,406, previously identified. Naturally it is important that the produce be centered as close as possible on the center line because if not, the slices will be of unequal cross section and small slivers will be wasted.

The produce, upon exiting the V-belt conveyor or a similar conveyance, enters a tube 27 having an inside diameter of sufficient size to readily receive it with the longitudinal axis extending along the direction of travel. Preferably this tube is of a size to prevent tumbling of the produce i.e. the internal diameter is less than the longitudinal length of the average produce size. In the embodiment shown, the tube forms a 90 degree curve to turn the produce straight down. The tube terminates at a planar member 28 positioned normal to the tube centerline and having a center opening 29 aligning with the tube. The opening 29 is square in the embodiment shown and is framed with a plurality of L cross sectioned frame members 30 one fixed to each side of the opening.

Attached to the downwardly extending leg of each frame member is a flexible spring member 31. Preferably these spring members are attached by bolts or rivets 32 passing through the upstream end thereof and having a flush surface for purposes to be explained later. The spring members are generally positioned equidistant from the center line 26 of the feed path and generally converge inward at the lower or downstream end 31A. Preferably the members are made of planar members formed in a truncated triangular shape and having adjacent edges positioned at the corners of the opening 29 and substantially abutting.

These spring members 31 preferably are formed of a material such as stainless steel or plastic of sufficient thickness to present a somewhat rigid wall yet being sufficiently resilient to allow the downstream end 31A to move outward under the force of an article such as a pickle or carrot dropping downward therethrough. The opening formed at the lower end 31A is sized to achieve the desired effect of causing each spring member inside surface to contact the side of the product passing therebetween. Preferably these spring members each have a slick inside surface so as to impart little or no resistance to the product passing therethrough. Also the spring members are positioned edge-to-edge in this embodiment but could be spaced along the center line from each other.

Figure 3:
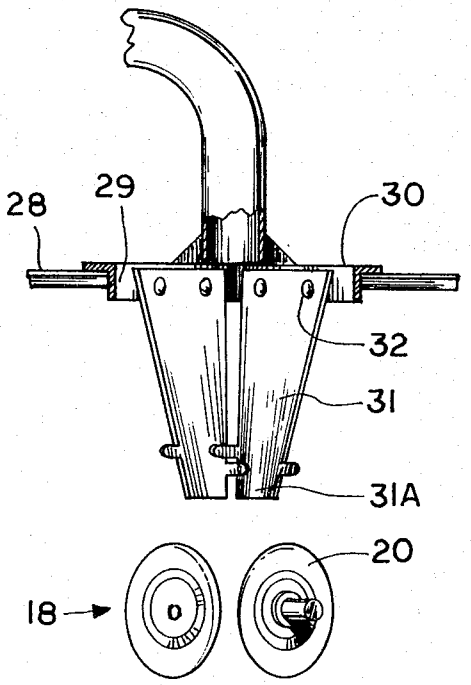
FIG. 3 is a cross sectional view along the line 3—3 of FIG. 2.

As shown in FIG. 3, each spring member has a pair of tabs 34 and 35 extending from opposite edges and in a direction parallel and adjacent to the inside surface of the next adjacent spring member. The tabs tend to push outward the adjacent spring members as the included spring member is deflected outward. This action reduces bounce of the article between the spring members and serves to center the articles better. Thus, even though the centering device will function without these interlocking tabs, a more efficient centering device is provided with their use.

Figure 5:
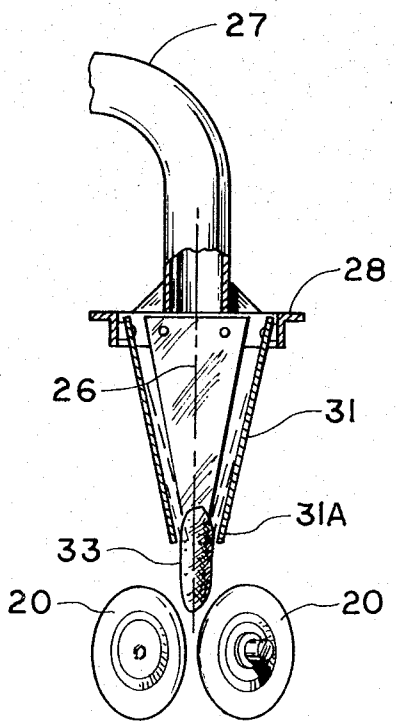
FIGS. 4 and 5 are cross sectional views along the lines 4—4 of FIG. 2 showing the centering device with and without a produce article passing therethrough.
Figure 4:
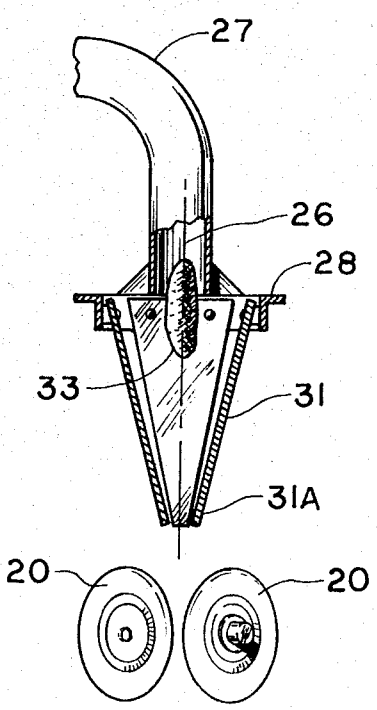

In operation the product 33 to be segmented is formed in single file and fed onto the trough belt feeder 10. The trough belt feeder sets the forward velocity of the product to the desired value and propels each article into the feed tube 27. The feed tube alters the direction of the produce from a horizontal path to a vertical path, the previous horizontal path was necessary to singulate and space the articles. It is advantageous for gravity to aid the driving of the article and preferable not alter the path as does occur as does when the article is propelled in the horizontal direction. While it is not absolutely necessary that the centering apparatus function on the the article moving straight downward, it is helpful. It is important, for instance, that the momentum of the article be maintained for proper operation of the centering device and the cutter mechanism. Thus the article passes from the tube into the passsageway formed by the spring plates as illustrated in FIG. 4. Thereafter the article passes to the position illustrated in FIG. 5, i.e. into contact with the spring plates which, if the article is centered on the desired feedpath, will all contact the article sides with equal force and be deflected outward to allow passage thereof into the cutter apparatus. However if the article is slightly off center, i.e. the center line of the article does not coincide with the center line of the desired feed path, the article will first contact one or two plates on one side of the path and the force of the plates will tend to shift the article back in the direction of the feed path as the article proceeds downward towards the cutter. In this manner the article is centered along the cutter's center line for segmenting into substantially equal segments.

The spring members are of a smaller cross section at the downstream end to allow converging and to make the spring members slightly more pliable at that end. Thus articles of smaller diameter, and therefore of less weight, will only contact the more resilient lower ends of the spring members and the necessary force for realigning the articles with the center line of the feed path in somewhat automatically adjusted.

To assist in maintaining the momentum of the product there is provided a water nozzle 35 (FIG. 1) aimed at the entrance to the feed tube. This water nozzle is positioned slightly above the path of the articles to direct a spray of water generally in the direction of movement of the articles. In this manner the articles are not deflected by the water spray. The water passes into the tube and down onto the spring members to not only clean the tube but maintain the surfaces lubricated to allow quick passage of the articles therethrough. For quick and efficient operation of this apparatus it is important that the articles maintain momentum and for this purpose the surfaces need to be maintained clean and as frictionless as possible.

Figure 6:
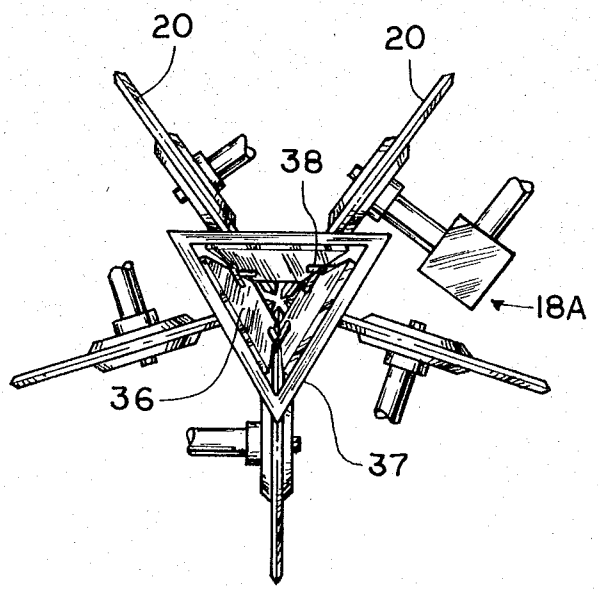
FIG. 6 is a second embodiment of the invention.

In FIG. 6 is shown another embodiment of the invention used for centering articles to be fed into the slicing apparatus 18A. The slicing apparatus includes a plurality of disc cutters 20 power rotated to slice articles fed therebetween. For centering the articles, three spring members 36 are fixed to a frame member 37 extending around the article feed path. As explained before, these spring members include overlapping tabs 38 which make the spring members move together towards and away from the article feed line. By utilizing fewer spring members, the angle therebetween is more acute to possibly better control the center positioning of the articles fed therethrough.

I claim:

1. A feed apparatus for use with a slicer having a plurality of blades mounted to converge on a common center line and segment articles fed along the center line at the infeed side of said blades, said feed apparatus comprising;

means to propel the articles along a path generally coinciding with the center line of the blades;

a plurality of elongated spring members;

means holding said spring members in a position around the center line with the inside surface of the upstream end adjacent said propelling means being positioned further away from the center line than the downstream end inside surface and with the downstream end being free to contact and deflect the articles toward the center line for centering the articles relative to the blades; and means connecting the downstream ends of said spring members to cause adjacent spring members to move outward together;

said means connecting the downstream ends being tabs extending from each downstream end in a direction overlapping and parallel to the inside surface of the adjacent spring members.

* * * * *